US007921773B2

(12) United States Patent
Röthlein et al.

(10) Patent No.: US 7,921,773 B2
(45) Date of Patent: Apr. 12, 2011

(54) DOCTOR BLADE SYSTEM

(75) Inventors: Ewald Röthlein, Retzstadt (DE); Helmut Schmidt, Wertheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 465 days.

(21) Appl. No.: 12/149,172

(22) Filed: Apr. 28, 2008

(65) Prior Publication Data

US 2009/0266256 A1 Oct. 29, 2009

(51) Int. Cl.

| | |
|---|---|
| ***B41F 31/00*** | (2006.01) |
| ***B41F 31/02*** | (2006.01) |
| ***B41F 9/10*** | (2006.01) |
| ***B05C 3/02*** | (2006.01) |

(52) U.S. Cl. ..... 101/350.6; 101/366; 101/169; 101/157; 118/413

(58) Field of Classification Search ..... 101/169, 101/350.6, 366, 157; 15/236.06; 118/410, 118/413

See application file for complete search history.

(56) References Cited

U.S. PATENT DOCUMENTS 2,284,222 A * 5/1942 Miller ..... 29/453
5,103,732 A * 4/1992 Wells et al. ..... 101/480
5,406,887 A * 4/1995 Hertel et al. ..... 101/366
5,560,264 A * 10/1996 Xolin et al. ..... 74/552
6,792,855 B2 9/2004 Pertile

FOREIGN PATENT DOCUMENTS

EP 1 398 152 A1 3/2004

* cited by examiner

*Primary Examiner* — Ren Yan
*Assistant Examiner* — Leo T Hinze
(74) *Attorney, Agent, or Firm* — Jones, Tullar & Cooper, P.C.

(57) ABSTRACT

A doctor blade system utilizes a lightweight doctor blade chamber to apply ink to an inking roller. The doctor blade chamber is removably positioned on a support plate which is, in turn, carried by linear guides on pivotable end plates. A rigid box beam is also attached to the end plates and is spaced from the support plate. A plurality of membrane cylinders are mounted on the rigid box beam and engage a surface of the support plate opposite to the surface that supports the doctor blade chamber. Through the application of suitable force, the support plate and its supported doctor blade chamber can be moved, by sliding motion on the linear slides, into uniform engagement with the surface of the ink roller. The system uses pivotable end plates which are supported by exterior plates that are, in turn, pivotably supported by press side frames. The chamber doctor blade and its support plate and box beam can be moved into several different positions, with respect to the cooperating ink roller, to facilitate doctor blade chamber cleaning or replacement or ink roller replacement.

24 Claims, 6 Drawing Sheets

DOCTOR BLADE SYSTEM

FIELD OF THE INVENTION

The present invention is directed generally to a doctor blade system. More particularly, the present invention is directed to a doctor blade system for use in a rotary printing press. Most specifically, the present invention is directed to a doctor blade system for use in a flexographic printing machine. The doctor blade system includes a doctor blade chamber of a light material. A full length support plate carries the doctor blade chamber. That support plate is biased across its width, in the axial direction of a cooperating anilox roller, by a plurality of membrane cylinders. Those several membrane cylinders are secured to a rigid cross member. The result is a lightweight doctor blade chamber which is not subject to the bending and distortion problems that have been prevalent in previous devices.

BACKGROUND OF THE INVENTION

In the field of rotary printing machines, it is generally well known to provide an inking unit that is equipped with a chamber doctor blade assembly. Such a chamber doctor blade assembly will include an elongated doctor blade chamber which is provided with a central, ink receiving reservoir. The doctor blade chamber central ink receiving reservoir is defined by two spaced doctor blades which extend in the axial direction of a cooperating ink roller, typically an anilox or screen roller. End plates are used at both ends of the doctor blade body to define, in cooperation with the two spaced doctor blades, the ink receiving reservoir.

Ink is supplied to the reservoir in the doctor blade body and is then applied to the surface of the anilox roller from that reservoir while the surface of the anilox roller or other similar inking roller passes through the ink reservoir defined by the two doctor blades and end plates. It is necessary that the ink being applied to the surface of the anilox roller be accurately and uniformly metered. Either too little ink, too much ink or an unequal ink thickness along the axial length of the anilox roller will cause degradation of the quality of the resultant printed product.

The force with which the two spaced doctor blades are engaged against the surface of the anilox roller is one way to meter the thickness of the ink layer which is applied to the surface of the anilox roller. While factors such as ink viscosity, roller rotational speed and the like will also affect the ink thickness, it is the force with which the doctor blades engage the pocketed or cell-covered surface of the anilox roller which is more determinative of the thickness of the ink layer which is applied from the ink reservoir in the doctor blade chamber to the anilox roller.

In early doctor blade systems, which were used with only single or double width printing cylinders, the structure of the doctor blade chamber could be of metal since weight was not a great consideration. The use of metal doctor blade chambers imparted a certain amount of structural rigidity to the doctor blade chamber. Biasing forces could be exerted on the chamber at the ends and would be applied relatively uniformly along the entire lengths of the working and closing doctor blades.

Printing presses now in use are characterized by four wide and six wide printing cylinders. The width of such a cylinder is thus four or six times the width of a newspaper page in broadsheet format. The width of the anilox inking roller thus is typically as great as the width of the printing cylinder. This results in the need for a doctor blade chamber that also has the width of up to six newspaper pages in broadsheet format. A traditional metal doctor blade chamber becomes too heavy to be usable.

The end seals and the doctor blades of the doctor blade chamber themselves are wear items which periodically must be replaced or refurbished. It is also necessary to periodically remove the doctor blade chamber from its associated mounting assemblies so that it can be cleaned or replaced. The doctor blade assemblies are also periodically thrown off or moved out of contact with the anilox roller so that the roller can be removed from the printing press. All of these requirements of the doctor blade chamber also mean that the weight of the doctor blade chamber needs to be kept at a minimum.

One material which has shown itself to be particularly suited for use in the formation of doctor blade chambers is glass fiber reinforced plastic or GRP. Such a material is light in weight and is extremely resistant to chemicals having extreme pH levels. Many currently used printing inks have such high pH levels. While an aluminum or an iron material can be imbued with similar resistance properties, this can be accomplished only through the use of costly and complicated coatings. Such coating are always subject to mechanical damage, such as chipping and scratching. The so-coated aluminum or iron doctor blade chambers are still very heavy and are thus difficult to mount, dismount and handle.

GRP doctor blade chamber structures satisfy the need for being light in weight, having durability and being resistant to high pH levels. Their primary limitation is a lack of structural rigidity, when compared with the previously used metal doctor blade chambers. The lack of structural rigidity results in twisting and bending of the doctor blade chamber across the width of the anilox roller. If the chamber flexes, distorts or bends, the two doctor blades do not contact the anilox roller with uniform pressure along the width of the anilox roller. The result of such non-uniform contact force is variance in the ink thickness application to the anilox roller, uneven wear of the doctor blades, premature end seal failures and other undesirable consequences.

In an effort to counteract or to compensate for the lack of structural rigidity of the GRP doctor blade chambers, as compared to the prior metal structures, various attempts have been made to rigidify such GRP doctor blade chambers. One prior attempt to overcome this lack of structural rigidity of GRP doctor blade chambers is set forth in EP 1 398 152 A1. In the system disclosed in that document, the doctor blade body is provided with elongated stiffening traction elements that extend parallel to the axis of the anilox roller, in the body of the doctor blade. These traction elements extend beyond the ends of the doctor blade body and are supported by. adjustment sleeves. Those sleeves are secured onto the ends of the traction elements and are actuated to impart a flexural movement to the doctor blade body that is asserted to be substantially equal and opposite to the flexural movement generated on the doctor blade body during the inking of the anilox roller.

Another arrangement, as proposed by KBA-Motter, uses a GRP chamber doctor blade that is mounted onto a shaft via plates which are welded to the shaft. That shaft is supported, at its outbound ends by pneumatic or hydraulic cylinders. The force required to adjust the doctor blade chamber is applied by these two cylinders. This is apt to result in a transverse deflection of the supporting shaft and of the doctor blade chamber. As discussed above, such a deflection results in distortion of the GRP doctor blade chamber, a twisting of the blade system and premature wear of the end seals. Another limitation of this prior system is that the working doctor blade is located closer to the axis of rotation of the anilox roller than is the closing doctor blade. The working doctor blade is thus subjected to greater wear and tear than is the closing doctor blade. As a result, more frequent maintenance is apt to be required.

It will be apparent that a need exists for a doctor blade system which overcomes the limitations of the prior device. The doctor blade system, in accordance with the present invention, provides such an assembly and system. It is a substantial improvement over the prior systems.

SUMMARY OF THE INVENTION

It is an object of the present invention to provide a doctor blade system.

Another object of the present invention is to provide a doctor blade system including a doctor blade support.

A further object of the present invention is to provide a doctor blade system having a plurality of membrane cylinders distributed over the length of the doctor blade support.

Yet another object of the present invention is to provide a doctor blade system usable with a glass fiber reinforced doctor blade chamber.

Even a further object of the present invention is to provide a doctor blade system having great structural rigidity.

Still yet another object of the present invention is to provide a doctor blade system which facilitates linear adjustment of the doctor blade chamber with uniform load application on both blades.

Yet still a further object of the present invention is to provide a doctor blade system which is structured to facilitate exchange of the anilox roller without removal of the doctor blade system from a press assembly.

As will be described in greater detail in the description of the preferred embodiment, and as depicted in the accompanying drawings, the doctor blade system, in accordance with the present invention utilizes a lightweight doctor blade chamber that provides an ink chamber defined by spaced working and closing doctor blades and cooperating end seals. The doctor blade chamber is preferably formed using glass fiber reinforced plastic GRP which is of reduced weight and which provides the desired high resistance to chemicals, such as printing inks having high pH levels.

The doctor blade chamber is removably mounted to a support plate. That support plate is positioned on linear slides so that it is movable in a direction toward and away from the anilox roller, with which the doctor blade chamber cooperates. The linear slides are secured to pivotable end plates. Quickly releasable blade chamber clamping elements on the support plate provide for efficient yet secure attachment of the chamber doctor blade to the support plate. Detachment of the chamber doctor blade from the support plate is easily accomplished.

A box beam is also attached to the pivotable end plates and is essentially parallel to, and spaced from the support plate. The box beam, as its name suggests, has a substantial amount of structural rigidity while still being relatively light in weight. The box beam is provided with a plurality of membrane cylinders that are located in the space between the box beam and the support plate. These membrane cylinders are aligned with the axis of rotation of the anilox roller and are spaced equally along the width of the box beam. Each membrane cylinder is brought into engagement with the support plate to which the doctor blade chamber is mounted. Suitable force is thus exerted, by the plurality of axially spaced membrane cylinders, against the support plate to insure that the doctor blade chamber is brought into proper, uniform engagement with the surface of the anilox roller. Each of the plurality of membrane cylinders can be provided with its own separate source of fluid under pressure, and with its own separate control so that each such membrane cylinder can be individually controlled. This will insure that the working doctor blade, the closing doctor blade and the end seals all are brought into, and remain in proper engagement with the anilox roller.

The doctor blade chamber itself does not require a great deal of structural rigidity. It is thus ideally suited to be fabricated using lightweight, chemically resistant materials, such as a glass fiber reinforced plastic or GRP. As a result, the doctor blade chamber, even if it has a length corresponding to that of an anilox roller with which it cooperates, and which is suitable for inking a six wide printing cylinder, is still sufficiently light in weight that it can be routinely handled and manipulated.

Attachment of the doctor blade chamber to the support plate is accomplished by the use of spaced blade chamber clamping elements. Since the chamber doctor blade, the support plate and the box beam are all supported by the spaced pivotable end plates, the doctor blade assembly can be pivoted through 90° for routine cleaning or through 120° for doctor blade chamber servicing or removal and replacement.

The doctor blade chamber itself does not require the inclusion of reinforcement bars, strips or other rigidifying elements which only serve to increase its overall weight. Instead, the doctor blade chamber relies on the support plate for its support. That support plate, in turn relies on the force imparted to it by the membrane cylinders carried by the box beam to impart to it the appropriate rigidity. Neither the support plate nor the box beams are intended to be routinely removed from the pivotable end plates. The support plate is supported on those end plates by linear slides so that it can move, without bending, toward and away from the surface of the anilox roller. Since the membrane cylinders are spaced equidistantly along the box beam and bear against the support plate at a multiplicity of points, the support plate can move along its linear guides to position its supported doctor blade chamber in proper, uniform engagement of the working and closing doctor blades with the surface of the anilox roller.

The two pivotable end plates are pivotably connected to exterior plates. Those exterior plates are, in turn, pivotably connected to inner surfaces of side frames of the printing unit. If it is necessary to move the entire doctor blade assembly, such as, for example, to exchange the anilox roller, this can be accomplished by pivoting the exterior plates at their points of attachment to the printing unit side frames. It is not necessary to totally disassemble the doctor blade assembly to allow for exchange of an anilox roller, when such a roller exchange may become necessary.

The doctor blade system, in accordance with the present invention, overcomes the limitations of the prior art. It allows the use of a lightweight, chemical resistant doctor blade chamber that can be moved and manipulated. Despite its lightweight and somewhat flexible nature, the doctor blade chamber is provided with structural rigidity by its positioning on its cooperating support plate. That support plate is positioned on linear guides and is movable toward and away from the surface of the anilox roller by the spaced membrane cylinders. The use of the box beam to carry these membrane cylinders insures their rigidity and accomplishes the accurate positioning of the doctor blade chamber in a highly controllable and reproducible manner.

The doctor blade system of the present invention overcomes the limitations of the prior art. It is a substantial advance in the art.

BRIEF DESCRIPTION OF THE DRAWINGS

A full and complete understanding of the doctor blade system, in accordance with the present invention, may be had by referring to the description of the preferred embodiment, as is set forth subsequently, and as depicted in the accompanying sheets of drawings, in which.

DESCRIPTION OF THE PREFERRED EMBODIMENT

Figure 1:
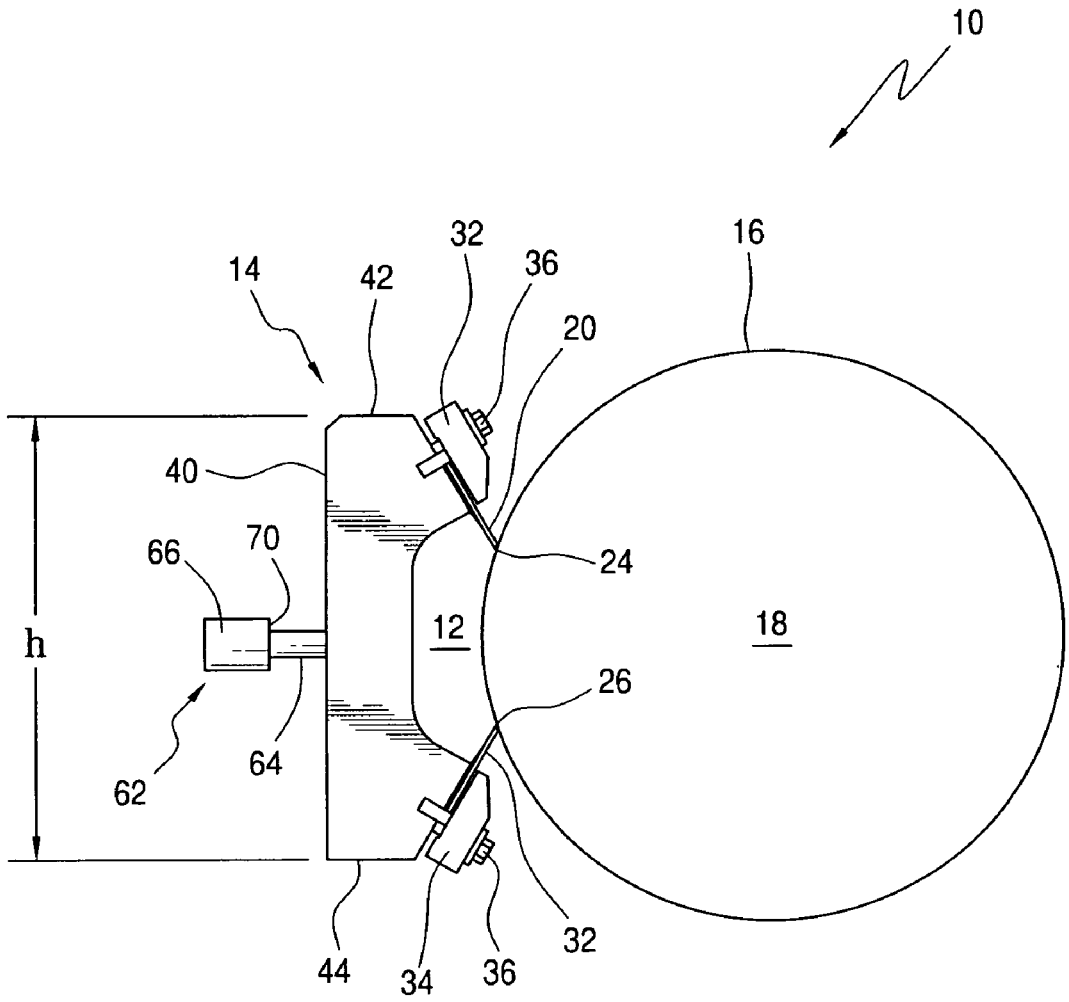
FIG. 1 is a schematic side elevation view of a doctor blade chamber in accordance with the present invention.
Figure 2:
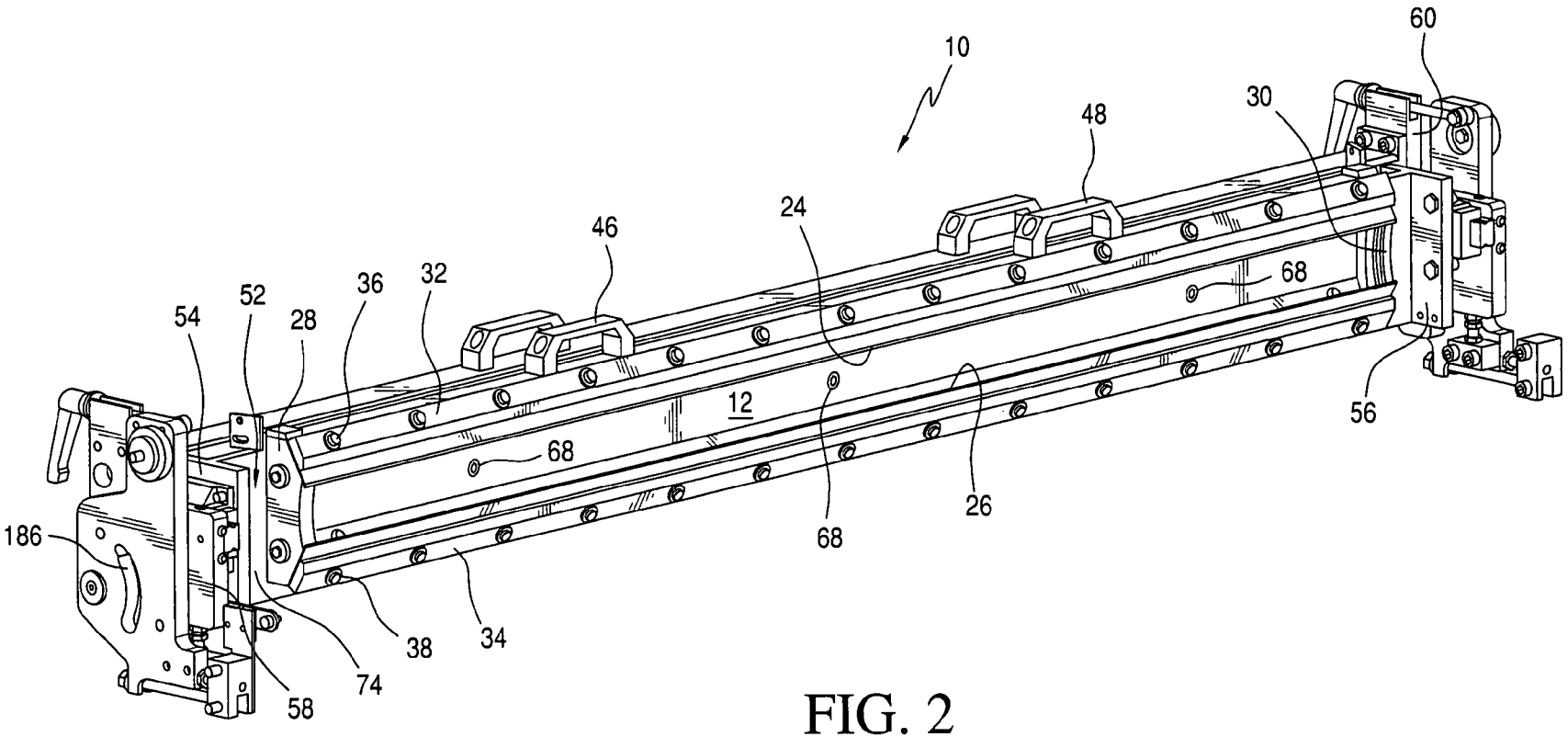
FIG. 2 is a front perspective view of the doctor blade system in accordance with the present invention and with the anilox roller removed for the sake of clarity.

Referring initially to FIG. 1, and taken in conjunction with FIG. 2, there may be seen, generally at 10, a preferred embodiment of a doctor blade system in accordance with the present invention. It will be understood that doctor blade system, generally at 10, is intended for use primarily in a flexographic printing system or in other generally well known printing systems. In such systems printing ink is supplied to an ink reservoir 12 in a doctor blade chamber, generally at 14. That ink is then transferred to the surface 16 of an ink roller, such as an anilox roller 18.

As is well known in the art, a doctor blade chamber, generally at 14 includes a working doctor blade 20 and a closing doctor blade 22 whose outer edges 24; 26, respectively, engage the surface 18 of the anilox roller 18. Suitable end plates 28 and 30, as seen more clearly in FIG. 2 cooperate with the working doctor blade 20 and the closing doctor blade 22 to define the ink reservoir 12. Seals are placed interiorly of the end plates but are not specifically depicted in FIG. 2. Clamping strips 32 and 34 are attached to the doctor blade chamber 14 by clamping bolts 36 to removably attach the two doctor blades to the doctor blade chamber, generally at 14.

Referring again to FIGS. 1 and 2, the doctor blade chamber, generally at 14 in accordance with the present invention, is preferably fabricated of a lightweight material that is highly resistant to chemicals with extreme pH levels. Glass fiber reinforced plastic or GRP is one such suitable material. While other materials are also suitable for use in the fabrication of the doctor blade chamber, generally at 14, GRP has been shown to be one particularly suitable material. Doctor blade chamber 14 includes a rear wall 40, an upper wall 42 and a lower wall 44, all as seen in FIG. 1. A pair of spaced doctor blade chamber handles 46 and 48 are spaced along the upper wall 42 of the doctor blade chamber 14. End plates 28 and 30, as discussed above, in cooperation with suitable end seals (not shown), complete the overall structure of the doctor blade chamber generally at 14.

While not specifically shown in FIG. 1, it will be understood that the doctor blade chamber 14 includes ink inlet and outlet fittings, which will be discussed in detail subsequently. The purpose of these ink inlet and outlet fittings is to allow the circulation of printing ink through the ink reservoir or ink chamber 12. It is from that ink flow that the ink is provided to the ink reservoir 12 and ultimately to the surface 16 of ink roller 18. The engagement of the edges 24 and 26 of the working and closing doctor blades 20 and 22, respectively is the mechanism by which the amount of ink transferred from the ink reservoir 14 to the ink roller surface 16 is controlled.

Figure 3:
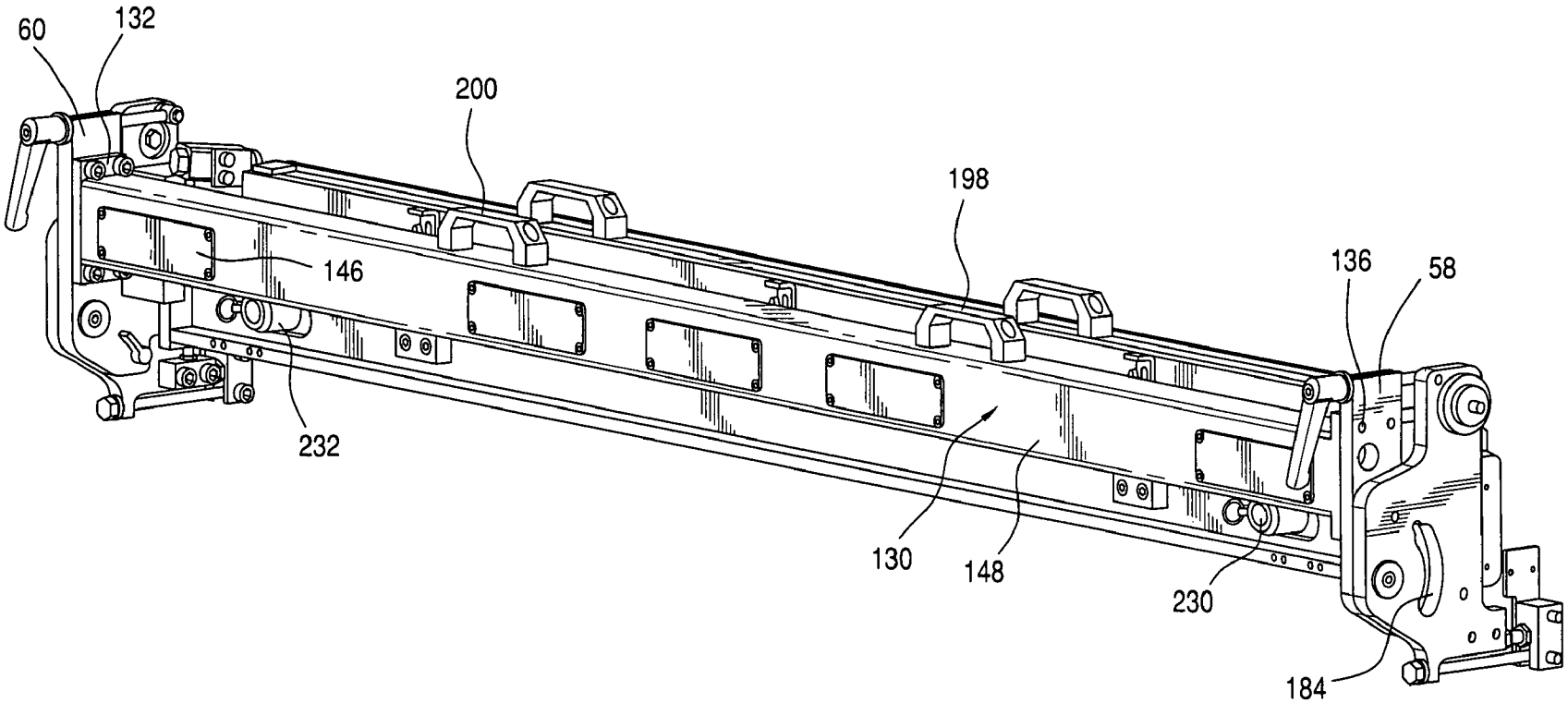
FIG. 3 is a rear perspective view of the doctor blade system of the present invention, again with the anilox roller removed.
Figure 4:
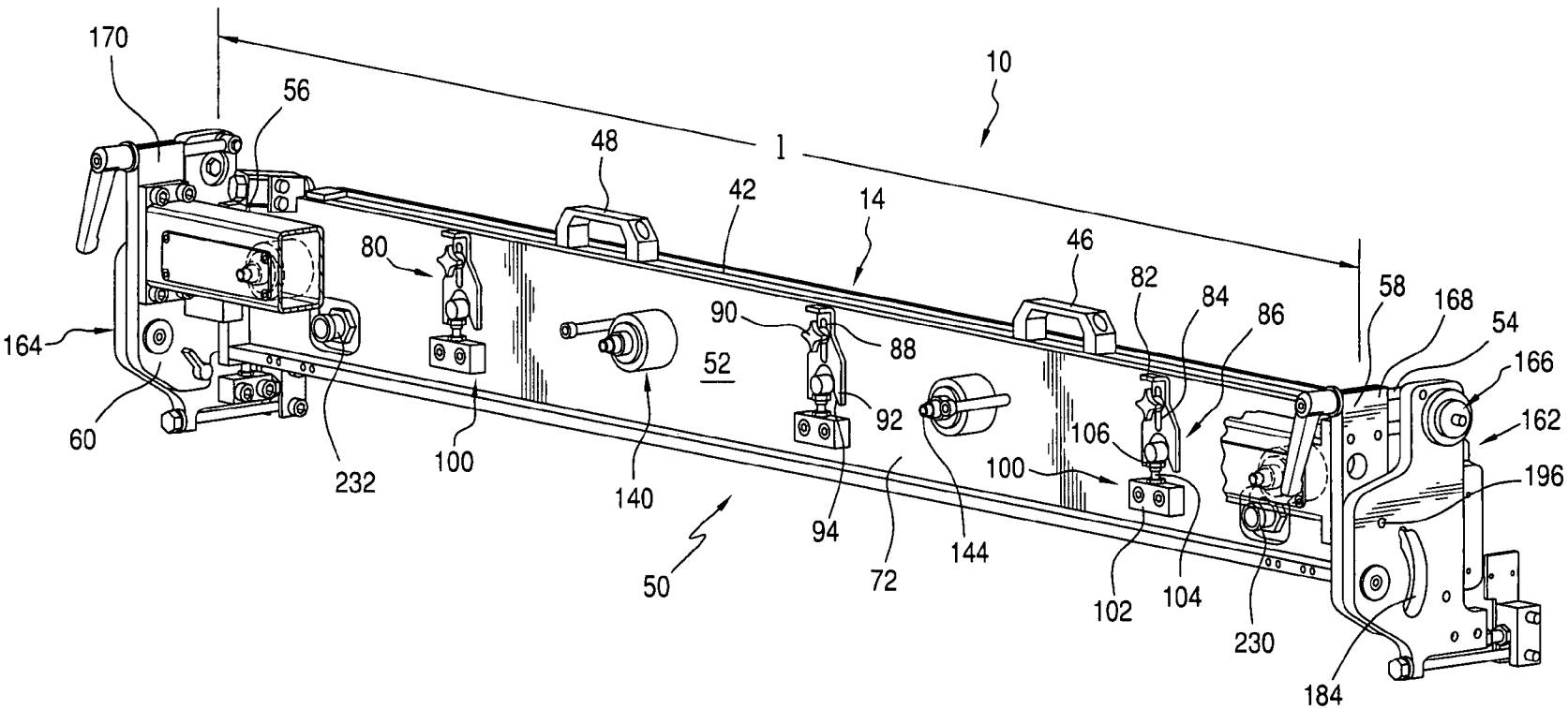
FIG. 4 is a rear perspective view, similar to FIG. 3 with the box beam of the doctor blade system removed.

Referring now to FIGS. 2 and 4, the doctor blade chamber 14 is securable to a full length support plate, generally at 50. Support plate 50 is a generally rectangular metal plate or beam that includes a generally planar central web 52, which is oriented generally vertically in the use position of the doctor blade system, generally at 10, as seen in FIGS. 1-4. Support plate, generally at 50, has a height generally equivalent to a height "h" of the rear wall 40 of the doctor blade chamber 14. A length "l" of the support plate 50 is greater than a cooperating length of the chamber doctor blade 14. A mounting flange 54 or 56 is secured at either end of the central web 52 of the support plate 50. Each such mounting flange 54 or 56 is generally perpendicular to the plane of the central web 52 of the support plate 50. The flanges 54 and 56 are used to attach the support plate 50 to spaced pivotable end plates, generally at 58 and 60 as will be discussed shortly.

The doctor blade chamber 14 is removably attachable to the support plate 50 and specifically to the central web of the support plate. To accomplish this releasable attachment, the rear wall 40 of the doctor blade chamber 14 is provided with spaced mounting studs 62, which are shown generally schematically in FIG. 1. Each such mounting stud includes a mounting stud shank 64 and an enlarged mounting stud head 66. Each such stud 62 may extend through the body of the doctor blade chamber 14 and could be secured by a suitable recessed retaining nut 68, as seen in FIG. 1. Other types of cooperative securement of the mounting studs 62 in the body of the doctor blade chamber 14 are also within the scope of the present invention.

The support plate central web 52 is provided with a plurality of somewhat ovoid or elongated through bores, which are not visible in the several drawings. These through bores, whose long axes extend vertically in the orientation of the support plate 50 shown in FIG. 4, are cooperatively spaced to receive the mounting studs 62 which are positioned on the rear wall 40 of the doctor blade chamber body. The shanks 64 of the mounting studs 62 are of an appropriate length which is slightly greater than a thickness of the central web 52 of the support plate 50. In this way, the stud heads 66 have inner surfaces 70 which will be spaced from a rear surface 72 of the central web 52 of the support plate when the rear wall 40 of the doctor blade chamber is in abutment with a front surface 74 of the central web 52 of the support plate 50.

Referring now to FIG. 4, there are provided a number of spaced doctor blade chamber locking lever assemblies, each generally at 80. Each such doctor blade chamber locking lever. 80 assembly includes an upper end with a gripping flange 82, a central body with an elongated slot 84 and a bifurcated lower wedging fork 86. A clamping screw 88 extends through each of the elongated slots 84 and has an enlarged gripper head 90. The wedging fork 86 has two spaced tines 92 which are sized to accept the shank 64 of the mounting stud 62 between them. The tines each have interior wedging surfaces that are engagable with the inner face 70 of the mounting stud when the locking lever is slid down so that the mounting studs 62 are positioned between the spaced tines 92 of each cooperatively located locking lever 80.

With the doctor blade system 10 rotated generally 120° in a counter-clockwise direction, in respect to the position shown in FIGS. 1-4, in a manner which will be discussed in detail shortly and which is depicted schematically in FIG. 7, the doctor blade chamber 14 is securable on, or removable from the support plate 50. Assuming that there is no doctor blade chamber 14 currently supported on the support plate 50, one can be brought into position and can be placed on the support plate central web 52. This is done by aligning the doctor blade chamber mounting studs 62 with the respective, somewhat elongated, mounting holes in the support plate 50, which holes are not specifically shown. The doctor blade chamber handles 46 and 48 can be used to help position the doctor blade chamber 14 on the support plate 50 so that the rear wall 40 of the doctor blade chamber is in engagement with the front surface 74 of the central web 52 of support plate 50. At this point, the locking lever assemblies 80 will be slid to their locking positions where the inner wedging surfaces 94 of tines 92 will engage the inner surface 70 of each cooperative one of the mounting studs 60. The support plate 60 can then be rotated back into a position where the central web 52 is generally vertical.

It is essential that the working doctor blade 24 and the closing doctor blade 26 be spaced equidistant from the axis of rotation of the anilox or inking roller 18. As may be seen in FIG. 4, the central web 52 of the support plate 50 is provided with at least two vertical stops 100, each one of which underlies one of the doctor blade chamber mounting studs 62. Each such vertical stop 100 includes a stop base 102 and a vertically adjustable stop pedestal 104. Each such stop pedestal 104 includes a stop head 106 which supports the stud head 66 of its respective one of the doctor blade chamber mounting studs 60. By vertical adjustment of the stop pedestals 104, the position of the doctor blade chamber 14 can be properly set so that the working doctor blade 20 and the closing doctor blade 22 are equidistant from the anilox roller axis of rotation. The positioning of these vertical stop pedestals is typically done by the factory and is not typically the subject of field adjustment.

Once the inner wedging surfaces 94 of the tines 92 of the locking levers 80 have been brought into firm engagement with the inner surfaces 70 of the mounting sheet heads 66, by firm downward pressure exerted on the locking lever gripping flanges 82, the gripper heads 90 of the clamping screws 88 can be used to clamp the locking levers 80 in place. This provides for positive securement of the doctor blade chamber 14 on the support plate 50. Removal of the doctor blade chamber 14 from the support plate 50 is accomplished by reversal of this procedure.

Figure 5:
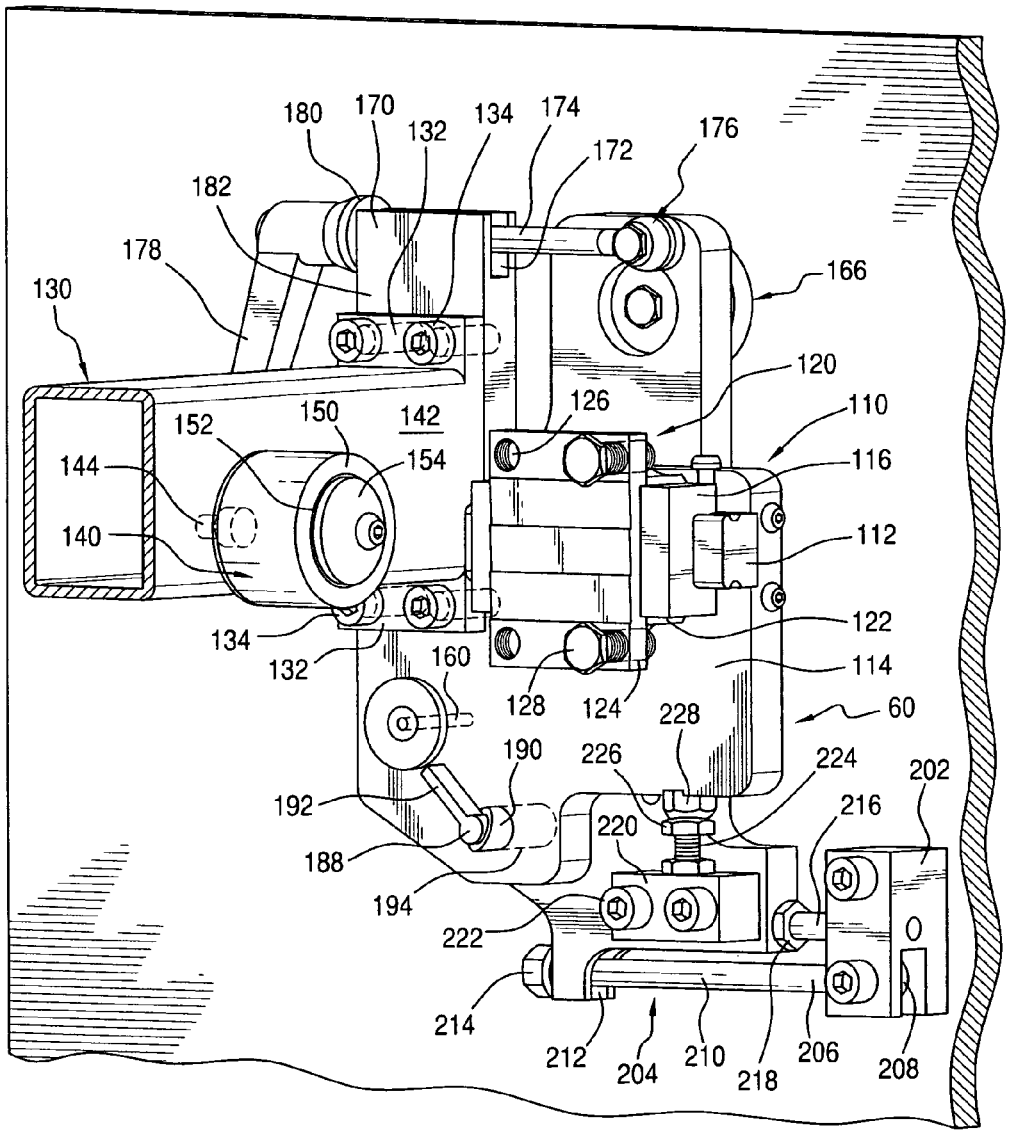
FIG. 5 is a perspective view of a portion of the doctor blade system and showing one of the membrane cylinders and the cooperating end plate and exterior plate assembly.

The support plate 50 is supported, at each of its ends, in a linear slide assembly, generally at 110, as may be seen in FIGS. 2, 4 and 5. Referring initially to FIG. 5, the linear slide assembly includes a slide rail 112 which is attached to each inner face 114 of its respective pivotable end plate 58 or 60. The slide rail 112 is dimensioned to receive, and to support, a cooperatively shaped slide block 116. The slide rail 112 and the slide block 116 are formed with a cooperating tongue and groove construction, or its structural and functional equivalent, so that the slide block 116 can move toward and away from the anilox roller 18 but cannot shift axially with respect to the anilox roller 18. If desired, the slide rail 112 and the slide block 116 could include suitable linear bearings to insure essentially friction free movement of each slide block 116 along its cooperating slide rail 112. It would also be possible to reverse the relative positions of the slide rail 112 and the slide block 116.

A support plate mounting flange securement bracket 120 is attached to each one of the linear slide blocks 116, again as may be seen most clearly in FIG. 5. Each of these securement brackets 120 includes a mounting channel 122 and a mounting plate 124. The mounting channel 122 is sized to be positionable over the slide block 116 and can be secured to it by welding or the like. The mounting plate 124 is generally planar and has a plurality of threaded bores 126, each of which is adapted to receive a cooperating bolt 128. As may be seen more clearly in FIG. 2, the mounting flanges 54 and 56 of the support plate 50 have their own bores, which are alignable with the threaded bores 126 on the mounting plates 124 of the support plate mounting flange securement bracket 120. The securement bolts 128 will pass through these bores in the mounting flanges 54 and 56, will be received in the threaded bores 126 of the mounting plates 124 and will thus positively connect the support plate 50 to the two pivotable end plates 58 and 60. The support plate 50 is thus securely, yet removably connected to its respective linear slide assemblies, generally at 110.

Turning now to FIG. 3, there may be seen a box beam assembly, generally at 130 which is also attached to the two spaced pivotable end plates 58 and 60. The box beam 130 is, as its name implies, a hollow structural member, preferably of metal, such as steel, and having a great amount of structural rigidity. A box beam 130 of this general construction thus provides its requisite structural rigidity while keeping its weight to a minimum. Each end of the box beam 130 is provided with its own mounting ears 132. These mounting ears 132 are provided with through bores that receive box beam mounting bolts 134. The bolts 134 are receivable in threaded bores 136 which are cooperatively formed in the end plates 58 and 60, as may be seen in FIGS. 3 and 5. Each end of the box beam 130 has both upper and lower mounting ears 132, as is shown most clearly in FIG. 5. The result is that the box beam 130 is very rigidly secured to the two pivotable end plates 58 and 60. While box beam 130 is depicted as a generally hollow, rectangular structural member, it will be understood that this is exemplary of a number of geometrical shapes which could be utilized to provide the requisite structural rigidity, while keeping the overall weight relatively low.

A plurality of membrane cylinders, generally at 140 are attached to a front face 142 of the box beam 130 by suitable fasteners 144. These membrane cylinder fasteners 144 are seen more clearly in FIG. 4 in which the box beam 130 has been omitted. These membrane cylinder fasteners 144 are also seen in dashed lines in FIG. 5 because they are within the confines of the interior of the hollow box beam 130. Suitable access plates 146 are attached to a rear face 148 of the box beam and cover access ports that provide access to the membrane cylinder fasteners 144 in case one of the membrane cylinders 144 has to be removed from the box beam 130.

The front face 142 of the box beam 130 is spaced rearwardly from the rear surface 72 of the support plate 50. The membrane cylinders 140 are sized to fit into the resultant space, which is seen most clearly in FIG. 3. Each of the membrane cylinders includes a cylinder body 150 and a cylinder plunger 152. Each such plunger 152 has a plunger face 154 that is engagable with the rear surface 72 of the support plate 50. As may be seen in FIG. 4, there are four such membrane cylinders 140 situated along the length of the box beam 130. That specific number of membrane cylinders 140 is only for purposes of illustration. The specific number of such membrane cylinders 140 will depend on the length of the box beam 130. It will be understood that these membrane cylinders 140 will be spaced equally along the box beam 130 and will be out of alignment, in an axial direction of the anilox roller 18, with the doctor blade chamber locking lever assemblies 80. Both the number of those locking levers 80 and the number of membrane cylinders 140 can be varied as a function of the length of the doctor blade chamber 14.

Each membrane cylinder 140 will be connected to a supply of fluid under pressure. Such fluid, such as compressed air, is readily available in a printing plant. The specific compressed air lines are not specifically depicted in the drawing figures for clarity of illustration. It will be understood that a suitable control assembly would be available to control the flow of compressed air to the membrane cylinders. While membrane cylinders 140 have been depicted and described in this preferred embodiment, it will be understood that other suitable force applying assemblies, such as linear actuators, piezoelectric devices, and the like could be substituted for the described and depicted membrane cylinders 140, whose function is to provide an equally distributed forward acting biasing force against the support plate 50.

The membrane cylinders 140 are aligned on the box beam 130, and the box beam is situated, with respect to the support plate 50, so that the points of engagement of the membrane cylinder plunger faces 154 will be in alignment with each other and equally as importantly will be aligned with the axis of rotation of the anilox roller. When the membrane cylinders are charged with the requisite amount of compressed air, the plunger faces will push against the rear surface 72 of the support plate 50 with sufficient force to move the support plate 50 forwardly along the linear slide assemblies 110 toward the anilox roller 18. The use of the two linear slide assemblies 110 assures that the support plate 50 will move toward the anilox roller 18 in a smooth linear manner. By controlling the pressure of fluid that is being supplied to the membrane cylinders 140, the force which the doctor blade edges 24 and 26 will exert against the surface 16 of the anilox roller 18 will be carefully controlled. Because there are a plurality of the membrane cylinders 140 spaced along the box beam 130, and due to the rigidity of that box beam 130, a controllable, certain force can be applied to the support plate 50 and thus to the surface 16 of the anilox roller 18 by the working doctor blade and closing doctor blade edges 24 and 26. In a similar manner, the seals, which are held in place by the end plates 28 and 30, are also engaged against the anilox roller with a positive, controllable force. The two desired goals of a lightweight doctor blade chamber and a structurally rigid doctor blade mount are thus provided by the doctor blade system of the present invention.

Figure 6:
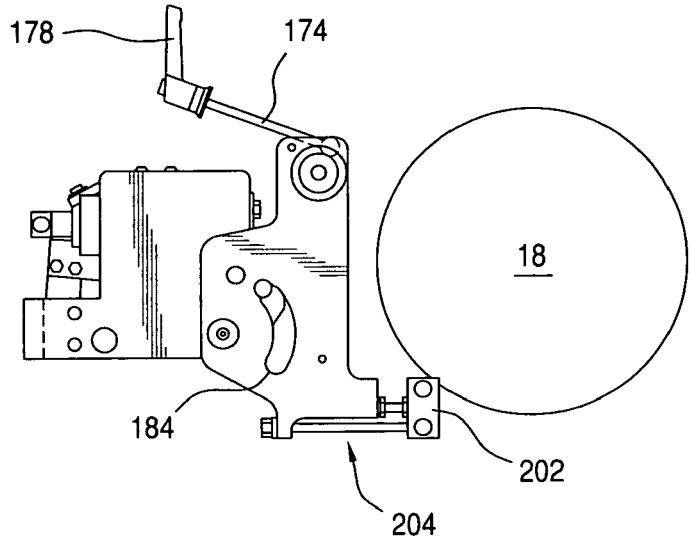
FIG. 6 is a schematic depiction of the doctor blade system rotated through 90° in a counter-clockwise direction for routine cleaning.

As mentioned previously, the doctor blade chamber 14, the support plate 50 and the box beam 130 are all attached to a pair of pivotable end plates 58 and 60. As may be seen in FIG. 5, this attachment is accomplished by the use of an inner pivot shaft 160 that extends between each end plate 58, 60 and its respective adjacent one of a pair of exterior plates 162 and 164. Those exterior plates 162 and 164 are, in turn, pivotably supported, by outer pivot shafts 166 to inner wall surfaces of the printing press side frames, one of which is shown schematically in FIG. 5. The inner end plates 58 and 60 are pivotable to move the doctor blade chamber either through generally 90° in a counter-clockwise direction with respect to the position shown in FIG. 3, and as seen in FIG. 6, to a first thrown-off position for maintenance of the doctor blade chamber and the doctor blades, or further to a second thrown-off position displaced by 120° in a counter-clockwise direction, as shown in FIG. 7, and again with respect to the position shown in FIG. 3, for removal of the doctor blade chamber 14 from its attachment to the support plate 50. The exterior plates 162 and 164 can be pivoted about their respective outer pivot shafts 166 through generally about 120° in a clockwise direction, with respect to their position seen in FIG. 3, to a doctor blade system thrown-off position, as seen in FIG. 8, in which the anilox roller 18 can be removed from the printing press.

Each of the two spaced end plates 58 and 60 has an upper fin 168, 170 respectively, as may be seen in FIGS. 2-5. As may be seen most clearly in FIG. 5, each one of these end plate upper fins 168, 170 is provided with a tension rod receiving channel 172. Each such tension rod receiving channel 172 is sized to receive a cooperating tension rod 174. An inboard end of each such tension rod 172 is attached to a respective adjacent exterior plate 162,164 by a swivel coupling 176. An outboard end of each tension rod 174 is provided with a tension lever 178. Each such tension lever 178 includes a cam plate 180. That cam plate 180 is brought into engagement with a rear surface 182 of the respective end plate upper fin 168, 170. In use, the tension lever 178 can be rotated by approximately 180°-270° to engage or disengage the cam plate 180 with the fin rear surface 182. That engagement or disengagement will either hold the tension rod 174 in the tension rod receiving channel 172, to thereby retain the doctor blade assembly in it operational position, or will allow movement of the tension rod 174 out of the cooperating receiving channel 172. In that disengagement position, the two end plates 58 and 60 can be pivoted, about their inner pivot shafts 160, with respect to the exterior plates 162 and 164, respectively, that support them.

Figure 7:
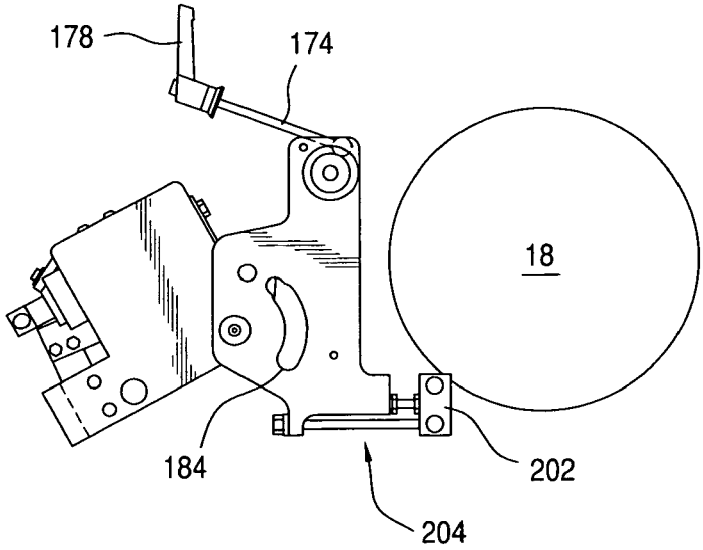
FIG. 7 is a view similar to FIG. 6 and showing the doctor blade system rotated through 120° in a counter-clockwise direction for doctor blade chamber removal.
Figure 8:
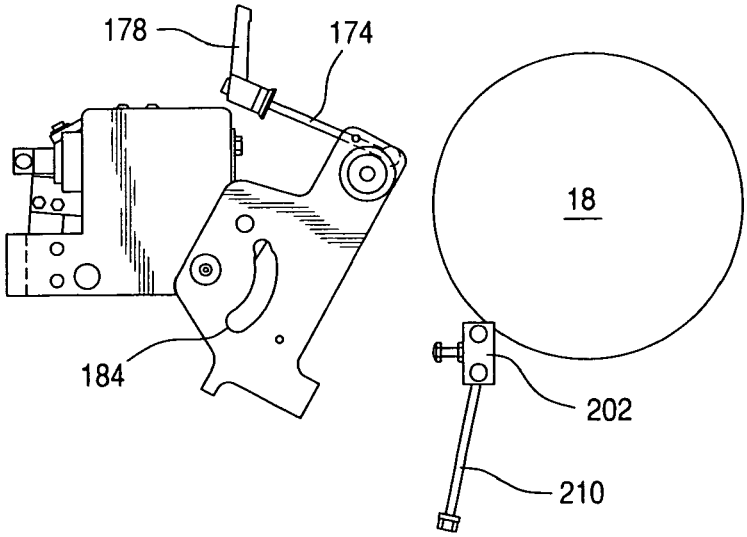
FIG. 8 is a view similar to FIGS. 6 and 7 and showing the doctor blade system rotated 120° in a clockwise direction for ink roller removal.

As was asserted previously, the end plates 58; 60 are pivotable, with respect to their associated exterior plates 162; 164 through either 90° or 120°, both in a counter-clockwise direction, as seen in FIGS. 6 and 7. The 90° rotation is used to facilitate the checking of the doctor blade chamber 14 and the associated doctor blades and end plates and seals. The 120° rotation is typically utilized when the doctor blade chamber 14 is to be removed from its associated support p late 50, in the manner described previously. As may be seen in each of FIGS. 2-4, each exterior plate 162, 164 is provided with an arcuate guide slot 184, 186. An index pin 188 is carried in each of the two end plates 58; 60. Each such index pin 188 includes an index pin shank 190 and an index pin actuating handle 192. Each of the two exterior plates has a lower blind bore 194 or an upper bore 196.

In the use position of the doctor blade chamber 14, the pin shank 190 of each index pin 188 is received in its associated one of the exterior plate blind bores 194. When it is necessary to rotate the doctor blade chamber 14 counter-clockwise through 90°, the tension rods 174 are released by rotation of the tension levers 178 and the tension rods 174 are pivoted up and out of their respective channels 172 about their respective swivel couplers 176. The tension rods can be held in their elevated positions by suitable biasing springs, which are not specifically shown, that are incorporated into the swivel couplings 176. Once the tension rods have been disengaged, the index pins 188 can be moved inwardly to disengage them from their blind bores 194 in the exterior plates 162; 164. The doctor blade chamber handles 48 and 46, and similar box beam handles 198, 200 can be manually engaged and the doctor blade chamber 14, support plate 50, box beam 130 and end plates 58 and 60 can be pivoted through 90° in a counter-clockwise direction. The index pins 188 can be reinserted into the slots 184 to limit the rotation to 90°, as shown schematically in FIG. 6. Alternatively, the index pins 188 can be inserted into the bores 196 located above the arcuate slots 184 to secure the now-rotated assembly at its 120° rotation position, as depicted schematically in FIG. 7.

In certain instances, such as when it is necessary to remove the anilox or similar ink roller 18, it is appropriate to rotate the entire doctor blade system through an upward rotation, in a clockwise direction, with respect to its position as depicted in FIGS. 2-4. This is accomplished by first rotating the end plates 58; 60 through their 120° positioned displacement, as discussed above, with respect to the exterior plates 162; 164. Once this has been accomplished, the exterior plates can themselves be rotated in a clockwise direction, with respect to their positions shown in FIGS. 2-5, about their respective outer pivot shafts 166 into the position depicted in FIG. 8.

As may be seen most clearly in FIG. 5, a base stop block 202 is secured to inner surfaces of the printing press side frame, as is shown schematically in FIG. 5. This base stop block 202 supports a tension screw 204 having a first, inboard end 206 that is received by a swivel mount 208 in the base stop block. A shank 210 of the tension screw 204 is received in a channel 212 in the lower edge of each exterior plate. A tension screw nut 214 is provided at an outboard end of the tension screw 204. Once the tension screw nut 214 has been backed off, the shank 210 of the tension screw 204 will drop out of the exterior plate channel 212. This will allow the exterior plates to pivot with respect to the side frames of the printing press, generally in a clockwise position, as seen in FIG. 8.

The base stop block 202 carries a first base stop 216. This first base stop 216 has an enlarged base stop head 218. The base stop head 218 is engagable with an exterior plate stop body 220. The exterior plate stop body 220 is secured to each one of its respective exterior plates by suitable set screws 222. Each of these exterior plate stop blocks 220 is provided with an upwardly extending end plate base stop member 224. That end plate base stop member 224 is provided with an enlarged end plate stop head 226 which engages a stop abutment 228 on the lower surface of each end plate 58; 60. As was the case with the vertical stops, generally at 100, these base stops 216 and 220 are adjusted and are secured in place during assembly of the doctor blade system, typically by factory personnel. They are not intended for adjustment in the field by the press operator.

Turning again briefly to FIG. 3, it will be seen that the doctor blade chamber, generally at 14 is provided with suitable quick disconnect ink hose connections 230 and 232. These are generally known in the art and need not be discussed in detail. They are used to connect the doctor blade chamber to an ink supply hose or line, at one end of the doctor blade chamber, and to a suitable ink return hose or line at the other end of the doctor blade chamber. Ink is thus caused to flow through the ink reservoir 12 in the axial direction of the ink roller 18.

The doctor blade system, in accordance with the present invention is a substantial improvement over prior systems. In a large printing press system such as one producing upwards of 2-2.5 million copies a day, prior doctor blade systems would require seal and blade replacements or adjustments every three to four weeks. The flexibility of the doctor blade chambers caused ink density variations, which led to print quality problems. These prior systems had high maintenance requirements and low operational stability.

In marked contrast, the doctor blade system in accordance with the present invention, has a seal life of up to 12 weeks. The structural rigidity that is provided by the overall system has greatly improved color density conformity. It is much easier for press personnel to change doctor blades and seals and to maintain the system. The present system can be adapted to existing press structure without particularly great changeover expenses.

While a preferred embodiment of a doctor blade system, in accordance with the present invention, has been set forth fully and completely hereinabove, it will be apparent to one of skill in the art that various changes, for example, in the specific structure of the ink roller, the drive for the ink roller, the supply of the printing ink and the like could be made without departing from the true spirit and scope of the present invention which is accordingly to be limited only by the appended claims.

What is claimed is:

1. A doctor blade system comprising:

a doctor blade chamber including at least one doctor blade adapted to engage a surface of an ink roller and extending in an axial direction of said ink roller;

mounting studs on said doctor blade chamber, said mounting studs each including a mounting stud head and a mounting stud shank;

a support plate releasably supporting said doctor blade chamber;

a plurality of spaced doctor blade chamber locking lever assemblies in said support plate, each of said spaced doctor blade chamber locking lever assemblies including a slidable locking lever having a bifurcated wedging fork;

mounting stud receiving apertures in said support plate aligned with said spaced doctor blade chamber locking lever assemblies, each said mounting stud being dimensioned to pass through a respective one of said support plate apertures and into cooperative engagement with a cooperative one of said bifurcated wedging forks;

means supporting said support plate for movement of said support plate and said doctor blade chamber generally transverse to said axial direction of said ink roller;

a rigid beam extending parallel to, and spaced from said support plate; and a plurality of force exerting elements interposed between said rigid beam and said support plate and usable to exert a biasing force on said at least one doctor blade against said surface of said ink roller.

2. The doctor blade system of claim 1 further including a second doctor blade on said doctor blade chamber and cooperating with said first doctor blade to define an ink receiving reservoir in said doctor blade chamber.

3. The doctor blade assembly of claim 1 wherein said plurality of force exerting elements are membrane cylinders.

4. The doctor blade assembly of claim 3 wherein each said membrane cylinder includes a cylinder body secured to said rigid beam and a cylinder plunger movable in said cylinder body.

5. The doctor blade assembly of claim 4 wherein each said cylinder plunger includes a plunger face engagable with said support plate.

6. The doctor blade system of claim 5 wherein said plurality of membrane cylinders are spaced uniformly in said axial direction of said ink roller and exert said biasing force in a direction perpendicular to said axis of said ink roller.

7. A doctor blade system comprising:

a doctor blade chamber including at least one doctor blade adapted to engage a surface of an ink roller and extending in an axial direction of said ink roller;

a support plate releasably supporting said doctor blade chamber;

means supporting said support plate for movement of said support plate and said doctor blade chamber generally transverse to said axial direction of said ink roller;

a rigid beam extending parallel to, and spaced from said support plate;

spaced end plates supporting said support plate and said rigid beam for pivotable movement with respect to a press in which said doctor blade system is adapted to be positioned;

a spaced mounting flange at each of first and second ends of said support plates adjacent said end plates;

linear guide assemblies connecting said support plate mounting flanges and said adjacent pivotable end plates; and a plurality of force exerting elements interposed between said rigid beam and said support plate and usable to exert a biasing force on said at least one doctor blade against said surface of said ink roller.

8. The doctor blade system of claim 7 wherein each said linear guide assembly includes a linear guide rail secured to one of each of said support plate mounting flange and said adjacent pivotable end plate, and a cooperating slide block secured to the other of each said support plate mounting flange and said adjacent pivotable end plate.

9. The doctor blade assembly of claim 7 wherein said plurality of force exerting elements are membrane cylinders.

10. The doctor blade assembly of claim 9 wherein each said membrane cylinder includes a cylinder body secured to said rigid beam and a cylinder plunger movable in said cylinder body.

11. The doctor blade assembly of claim 10 wherein each said cylinder plunger includes a plunger face engagable with said support plate.

12. The doctor blade system of claim 11 wherein said plurality of membrane cylinders are spaced uniformly in said axial direction of said ink roller and exert said biasing force in a direction perpendicular to said axis of said ink roller.

13. The doctor blade system of claim 7 further including a second doctor blade on said doctor blade chamber and cooperating with said first doctor blade to define an ink receiving reservoir in said doctor blade chamber.

14. A doctor blade system comprising:

a doctor blade chamber including at least one doctor blade adapted to engage a surface of an ink roller and extending in an axial direction of said ink roller;

a support plate releasably supporting said doctor blade chamber;

means supporting said support plate for movement of said support plate and said doctor blade chamber generally transverse to said axial direction of said ink roller;

a rigid beam extending parallel to, and spaced from said support plate;

spaced end plates supporting said support plates and said rigid beam for pivotable movement with respect to a press in which said doctor blade system is adapted to be positioned;

exterior plates interposed between each said pivotable end plate and said press; and a plurality of force exerting elements interposed between said rigid beam and said support plate and usable to exert a biasing force on said at least one doctor blade against said surface of said ink roller.

15. The doctor blade system of claim 14 wherein each of said exterior plates is connected to said press frame for pivotable movement with respect to said press frame.

16. The doctor blade system of claim 15 wherein each said exterior plate is pivotable in a first direction of rotation with respect to said press frame and each said end plate is pivotable in a second direction with respect to said press frame, said first and second directions being opposite to each other.

17. The doctor blade system of claim 16 wherein said end plates are pivotable with respect to said exterior plates between a first operating position, a second cleaning position and a third doctor blade chamber removal position and further wherein said exterior plates are pivotable with respect to said press frame between a first operating position and a second ink roller removal position.

18. The doctor blade system of claim 14 further including an arcuate guide slot in each said exterior plate and a cooperating guide pin in each said plate, said guide slots and said guide pin defining a range of pivotal movement of each said end plate with respect to its associated one of said exterior plates.

19. The doctor blade system of claim 14 further including releasable tension rods releasably coupling each said end plate and each said cooperating exterior plate.

20. The doctor blade assembly of claim 14 wherein said plurality of force exerting elements are membrane cylinders.

21. The doctor blade assembly of claim 20 wherein each said membrane cylinder includes a cylinder body secured to said rigid beam and a cylinder plunger movable in said cylinder body.

22. The doctor blade assembly of claim 21 wherein each said cylinder plunger includes a plunger face engagable with said support plate.

23. The doctor blade system of claim 22 wherein said plurality of membrane cylinders are spaced uniformly in said axial direction of said ink roller and exert said biasing force in a direction perpendicular to said axis of said Ink roller.

24. The doctor blade system of claim 14 further including a second doctor blade on said doctor blade chamber and cooperating with said first doctor blade to define an ink receiving reservoir in said doctor blade chamber.

* * * * *